US006619911B1

(12) United States Patent
Engländer et al.

(10) Patent No.: US 6,619,911 B1
(45) Date of Patent: Sep. 16, 2003

(54) FRICTION VACUUM PUMP WITH A STATOR AND A ROTOR

(75) Inventors: Heinrich Engländer, Linnich (DE); Alexander Bosma, Köln (DE); Hans-Rudolf Fischer, Erftstadt (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/807,101

(22) PCT Filed: Jul. 28, 1999

(86) PCT No.: PCT/EP99/05394

§ 371 (c)(1),
(2), (4) Date: Apr. 6, 2001

(87) PCT Pub. No.: WO00/20762

PCT Pub. Date: Apr. 13, 2000

(30) Foreign Application Priority Data

Oct. 7, 1998 (DE) ..... 198 46 188

(51) Int. Cl.[7] ..... F01D 1/36
(52) U.S. Cl. ..... 415/90; 415/143
(58) Field of Search ..... 415/90, 143; 417/423.4

(56) References Cited

U.S. PATENT DOCUMENTS

| | | | | |
|---|---|---|---|---|
| 4,732,529 A | 3/1988 | Narita et al. | ..... | 415/90 |
| 4,893,985 A | 1/1990 | Hölss | ..... | 415/90 |
| 5,893,702 A | 4/1999 | Conrad et al. | ..... | 415/71 |
| 5,895,202 A | 4/1999 | Dauvillier | ..... | 415/90 |

FOREIGN PATENT DOCUMENTS

| | | |
|---|---|---|
| DE | 24 12 624 C2 | 10/1974 |
| DE | 32 04 750 A1 | 8/1983 |
| DE | 196 32 375 A1 | 2/1998 |
| EP | 0 748 940 | 12/1996 |
| FR | 2 310 481 | 12/1976 |
| FR | 2 619 867 | 3/1989 |
| FR | 2 630 167 | 10/1989 |

*Primary Examiner*—Edward K. Look
*Assistant Examiner*—Kimya N McCoy
(74) *Attorney, Agent, or Firm*—Fay, Sharpe, Fagan, Minnich & McKee, LLP

(57) ABSTRACT

A molecular vacuum pump (1) includes a stator unit (9) which has a stator blade package including one or more rows of stator blades (42), and a rotor unit (8) which has rotor blade package including one or more rows of rotor blades (41). The rotor blades (41) and the state blade (42) intermesh with each other in the functionally assembly state. The rotor blades 941) include slots (61) whose arrangement, depth and width are selected such that the stator unit (9) and the rotor unit (8) may be screwed together or unscrewed from one another. Alternatively, the stator blades (42) include slots (61) whose arrangement, depth and width are selected such that the stator unit (9) and the rotor unit (8) may be screwed together or unscrewed from one another.

27 Claims, 5 Drawing Sheets

FRICTION VACUUM PUMP WITH A STATOR AND A ROTOR

BACKGROUND OF THE INVENTION

The present invention relates to a molecular vacuum pump with a stator having a stator blade package including several rows of stator blades, as well as a rotor having a rotor blade package including several rows of rotor blades. The rows of stator blades and the rows of rotor blades intermesh with each other in functionally assembled state.

With the known molecular vacuum pumps of this type, the stator and rotor, in cross section, form a ring shaped transport chamber, into which the rows of stator and rotor blades project in intermeshing fashion. The pitch angles of the stator blades are inversely oriented vis-a-vis the pitch angles of the rotor blades with regard to their blade row plane.

The rotor of these type of friction vacuum pumps is traditionally designed in one piece, while the stator has a multitude of components. The stator ring package typically includes two semi-annular shape components, each with intermeshing profiles; that alternate with stator blade rings, which are joined to define the stator. With respect to manufacture as well as installation of disassembly, friction vacuum pumps of this type are extremely costly. Additional drawbacks are as follows:

- Due to the multitude of components, relatively large gaps result between stator and rotor, which leads to relatively high backstreaming losses;
- with small pumps, the handling of the working components becomes particularly problematical during installation;
- despite reduction in the size of the components, no noticeable cost reduction can be achieved vis-a-vis larger pumps.

The present invention is based on the object of creating a friction vacuum pump of the initially mentioned kind, which no longer has the described drawbacks.

SUMMARY OF THE INVENTION

According to one aspect of the invention, said object is solved in that the blades of one of the two blade packages are equipped with slots, whose arrangement, depth and width are selected in such fashion that stator and rotor can be screwed together and unscrewed from each other. With a molecular vacuum pump of this type it is no longer necessary to produce the stator from a multitude of components.

Stator as well as rotor can respectively be designed in one piece and can thus be produced cost-effectively. The handling of components of this type during installation is significantly less complicated. The gaps between rotor and stator can be drastically reduced, since, due to the reduced number of components. There is significant reduction in the extent of permissible tolerance. This results in smaller backstreaming losses or improved pumping properties. The tooling costs for the production of the stator are significantly lower, so that more flexible stator designs are no longer associated with particularly high increases in cost.

It is of particular benefit that blades may be provided on the interior side of the rotor, for example of a bell-shaped rotor, which correspond to stator blades of an inner stator. In particular, with pumps having co-axially nested vane cylinders, lower construction height can be achieved. In addition, with a blade configuration of this type, the motor and the storage compartment can be evacuated as a safeguard against the utilization of aggressive or reactive gases. Separate blocking gas equipment can be eliminated.

Ultimately, it is of benefit that the blade lengths may be as small as desired. If they have a length, for example, which corresponds to the depth of a threaded known with Holweck-Pump stages, then a new pump surface geometry is created (Englander geometry) which is particularly effective in the field of laminar or viscous flow. For all practical purposes, there is a constant change between rotor and stator thread gear, so that there is substantial reduction in backstreaming compared with the Holweck Technique. Pump surface according to the new pump surface geometry are effective even when the laminar flow changes to turbulent flow, so that significant improvement is achieved with respect to pre-vacuum stability. Another benefit lies in that it is possible to change over, continuously, from the Turbo-Principle to the Englander Geometry, which makes it possible to prevent transfer losses and improve the overall efficiency degree of the pump.

Another reduction in backstreaming losses can be obtained in that stator and rotor can be coupled relative to vibration and that the system comprising stator unit and rotor unit is jointly fastened in the housing by means of vibration elements.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENT

Figure 1:
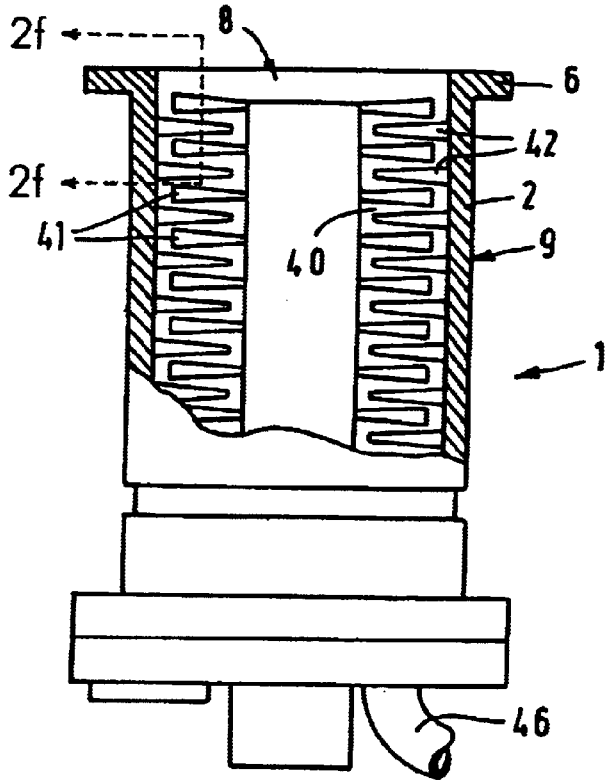
FIG. 1 depicts a schematically represented turbo-molecular vacuum pump.

With reference to FIG. 1, the molecular pump 1, preferably a turbo-molecular pump, includes a housing 2, a rotor unit 8, and a stator unit 9, which simultaneously forms the housing 2. Components of the rotor units 8 include rotor blades 41, components of the stator using 9 include stator blades 42. These blades 41 and 42 are arranged in known fashion in rows and protrude into the, in cross-section ring-shaped, transport compartment 40. They effect the transport of gas from inlet flange 6 to outlet 46.

Figure 2A:
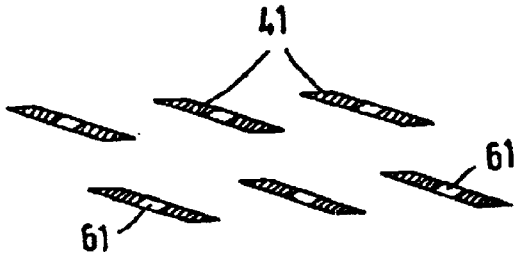
FIG. 2*a* shows a cross-sectional view of the rotor blades in accordance with one embodiment of the invention.
Figure 2B:
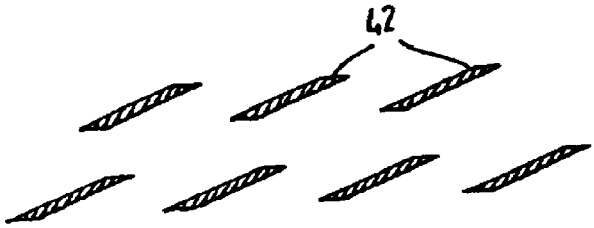
FIG. 2*b* shows a cross-sectional view of the stator blades in accordance with the embodiment of FIG. 2*a,*
Figure 2C:
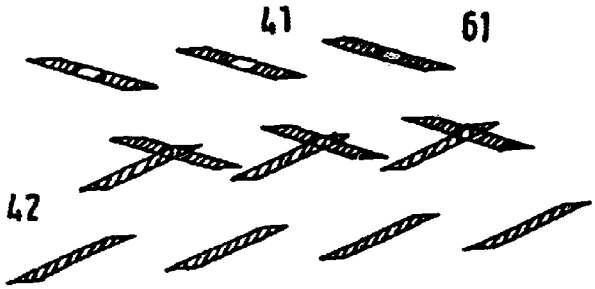
FIG. 2*c* shows a cross-sectional view of the rotor blades and stator blades starting to be screwed together.
Figure 2D:
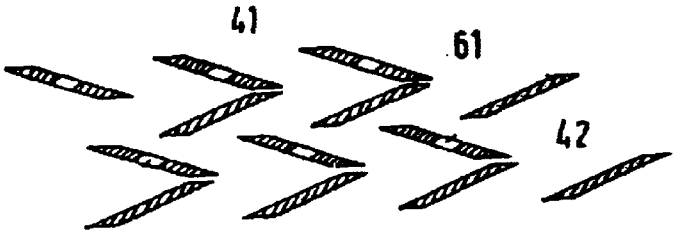
FIG. 2*d* shows a cross-sectional view with the lowermost rotor blades and the uppermost stator blades interleaved.
Figure 2E:
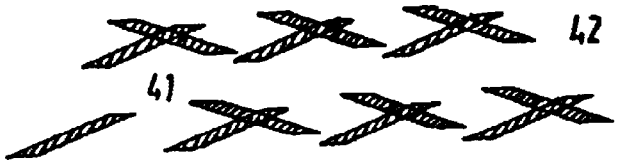
FIG. 2*e* shows a cross-sectional view of the rotor blades and the stator blades being screwed further together.
Figure 2F:
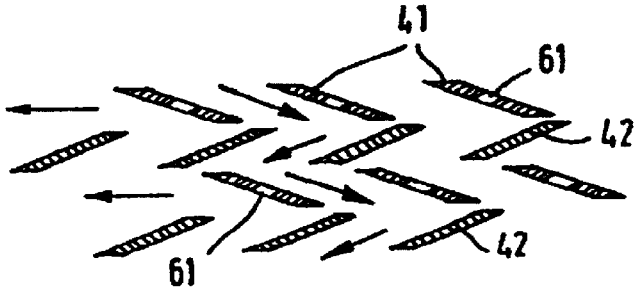
FIG. 2*f* is a cross-sectional view of the rotor and stator blades taken through section 2f—2f of FIG. 1 which shows an operational position of the blades in accordance with the embodiment of FIGS. 2*a*–2*e,*

With reference now to FIGS. 2*a, b, c,* the Figures represent partial sections through designs of both—rotor blades 41 (FIG. 2*a*) and of stator blades 42 (FIG. 2*b*) as well as of rotor and stator blades in functionally assembled state (FIG. 2*c*). The rotor blades 41 are equipped with slots 61 in such fashions that rotor unit 8 and stator unit 9 can be screwed together and unscrewed from each other. The depth and width of slots 61 in the rotor blades 41 is selected in such manner that pass-through of stator blades 42 during the screw action is assured. These slots can be kept narrow if all stator blades 42 have the same pitch angle. Preferably, the respectively paired rotor vane- and stator vane packages have the same angle for all stages. The vane depth can vary in such arrangement. One package has a slot in the vanes having the angle of the paired package. The slot which is a little larger than the thickness of the paired vane. Via these slots, both packages can be screwed together. Alternatively, instead of the rotor blades 41, the stator blades 42 can be equipped with appropriate slots.

Figure 3:
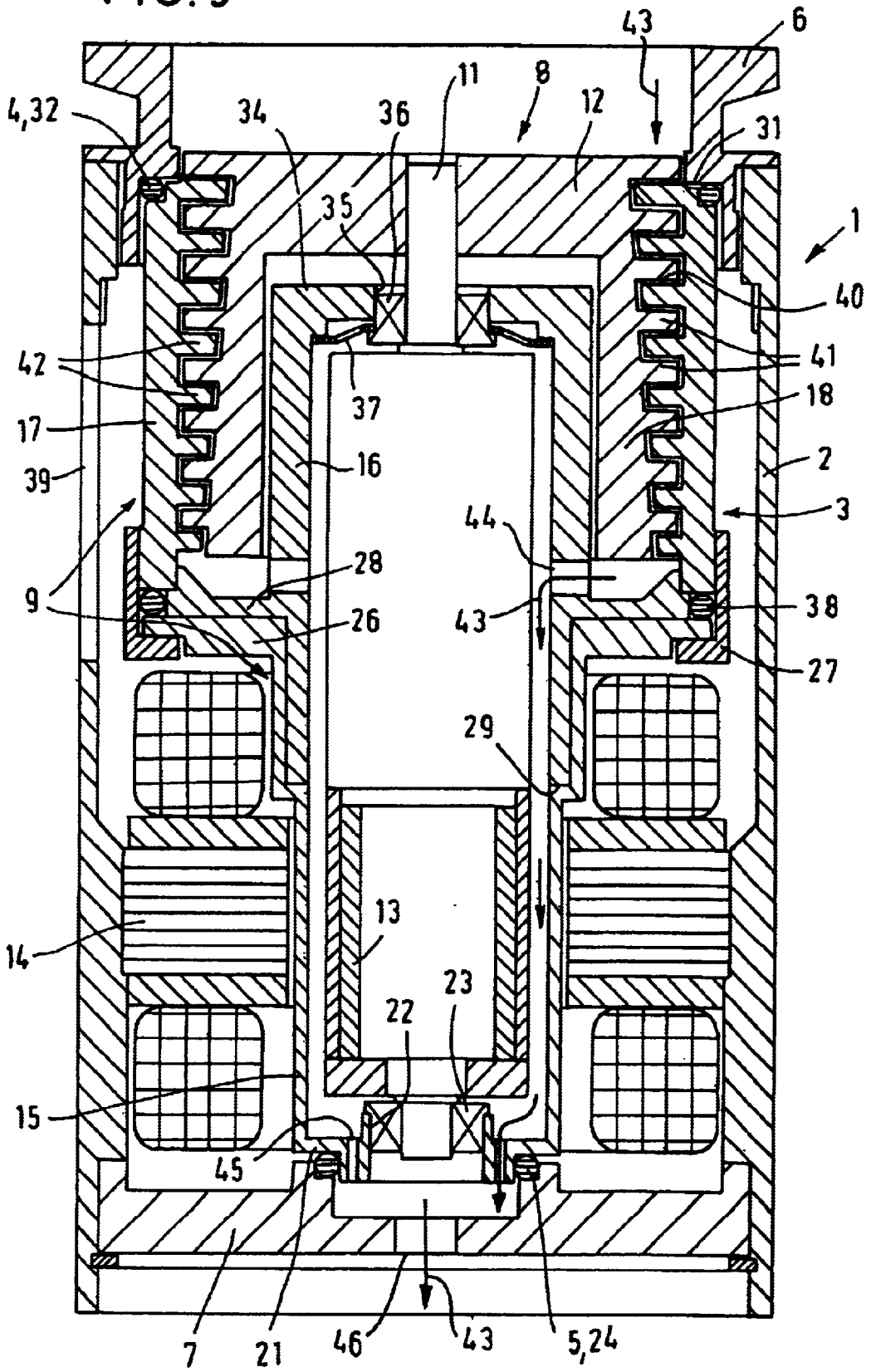
FIG. 3 depicts a section through a turbo-molecular vacuum pump with cross-sectionally tapering transport compartment.
Figure 4:
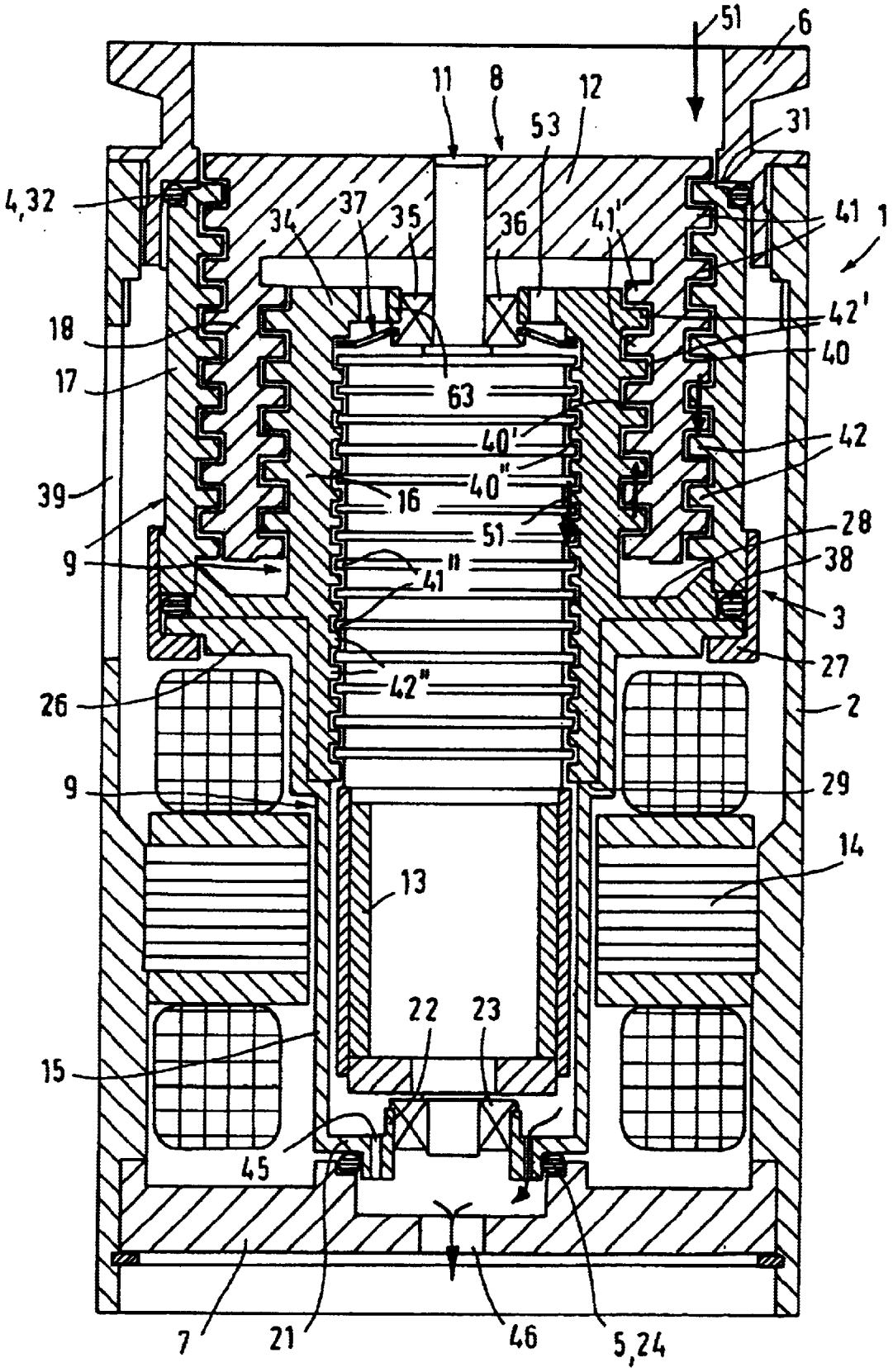
FIG. 4 depicts a section through a three-stage exemplary embodiment with co-axially nested vane cylinders.
Figure 6A:
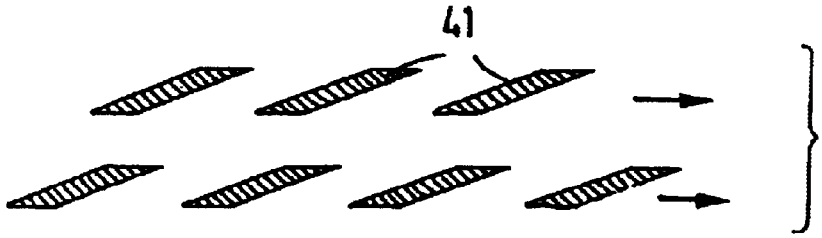
FIG. 6*a* shows a cross-sectional view of another embodiment of the rotor blades.
Figure 6B:
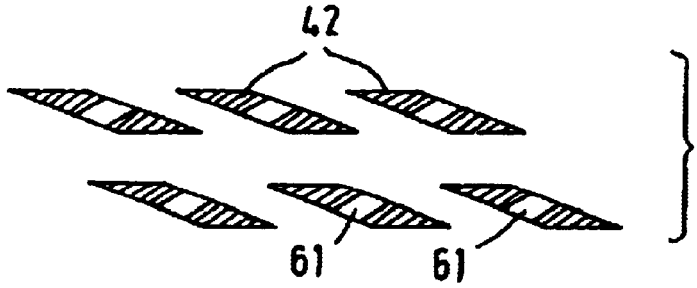
FIG. 6*b* shows a cross-sectional view of the stator blades in accordance with the embodiment of FIG. 6*a,*
Figure 6C:
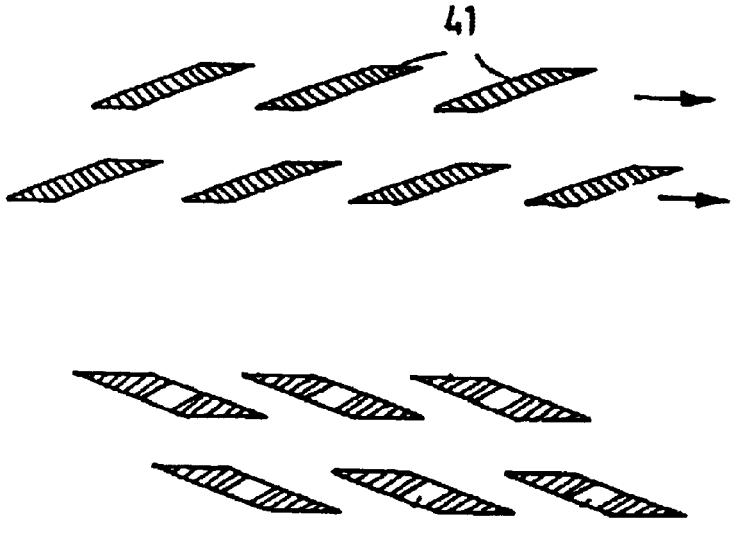
FIG. 6*c* shows a cross-sectional view of the rotor blades and stator blades of the embodiment of FIGS. 6*a* and 6*b* with the helical trajectory along which the rotor and stator blades are screwed together illustrated in dashed lines.
Figure 6D:
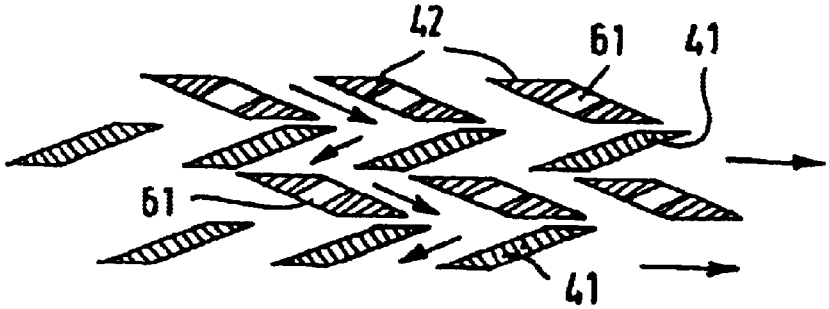
FIG. 6*d* shows a cross-sectional view of the rotor blades and stator blades in an operational position in accordance with the embodiment.

The pumps 1 according to FIGS. 3 and 4 respectively include an outer housing 2 rotor- and stator system 3, supports itself in housing 2 by means of vibration damping elements 4, 5. The housing 2 supports, on the suction side, a connection flange 6 and, on the pressure side, a connection cover 7. The rotor-stator system 3 comprises the rotor unit 8 and the stator unit 9.

Another component of the rotor unit 8 is the central shaft 11, which supports, on the suction side, an essentially bell-shaped rotor 12. On the pressure side, the shaft 11 is equipped with armatures 13 of the drive motor. The stator of the drive motor 14 is supported in the housing 2.

The stator unit 9 includes three sleeve components 15, 16, 17, of which one (15) is arranged on the pressure side, and the other two (16, 17) on the suction side (inside and outside of the wall 18 of the bell-shaped rotor 12). The pressure side end of the sleeve 15 is fitted with an inwardly oriented edge 21, whose inner side is designed as slide fit 22 for the shaft bearing 23 on the pressure side. In addition, the edge 21 is equipped with a receiving region for an O-ring 24 of elastomer material. A corresponding acceptance is provided at the connection lid 7 of the housing 2. The receiving region (grooves, angles or similar) are designed in such fashion that the O-ring 24, aside from its sealing function, has the function of a first, pressure-side positioned vibration damping element 5, by means of which the rotor-stator system 3 supports itself in housing 2. Instead of O-ring 24, other vibration damping elements may also be provided (for example radial packaging rings, flat rings, piston seals).

In order to form an interior vacuum-tight housing, the sleeve 15 is fitted, on the suction side, with an outwardly oriented edge 26, to which are attached the two additional sleeves 16, 17. This is done, from the pressure side, with a screwed cap nut 27, which braces the outer edge 26 at sleeve 15 and an outer edge 28, which is a component of the inner sleeve 16.

The connection flange 6 is equipped, on the suction side, with an inwardly directed step 31 for receiving another O-ring 32 or another vibration damping element. A corresponding receiving region is located in the area of the frontal side of the sleeve 17. The O-ring 32 forms, aside from its sealing function, the second vibration damping element by means of which the rotor-stator system 3 supports itself in the housing 2. The housing 2 forms a tension sleeve, which, together with lid 7 and connection flange 6 braces the rotor-stator system 3. Additionally, the second sleeve 16 supports itself on a step-like expansion 29 inside the sleeve 15.

The suction side end of the inner sleeve 16 is fitted with an inwardly oriented edge 34, whose inner side forms a slide fit 35 for the suction-side shaft bearing 36. In addition, there is an annular spring 37 in this area, which generates the needed bearing pitch forces.

In these two exemplary embodiments, the rotor unit 8 and the stator unit 9 are rigidly coupled with each other via bearings 23, 36 and the slide fits 22, 35. As a result, the desired reduction in play between stator and rotor is attained. The rotor-stator system 3 supports itself in the housing 2 via the vibration damping elements 4 and 5. Designing the vibration damping elements as O-rings has the advantage that they can simultaneously assume sealing function. They provide a vacuum-tight separation between the inside positioned transport compartments and the atmosphere. Another O-ring 38 appropriately surrounds the outer circumference of an edge 28, which supports the inner sleeve 16, so that there is also assurance of vacuum-tightness in the area of the screwed cap nut. The stator unit 9, for all practical purposes, forms a second interior housing. It is vacuum tight, so that it is possible to equip the outer housing 2 with air slots 39.

The exemplary embodiment according to FIG. 3 is a single-flow turbo-molecular vacuum pump with a transport compartment 40 tapering from the suction side toward the pressure side. The outer sleeve 17 supports, on its interior side, the stator blade rows 42, the exterior side of the rotor wall 18, and rotor blade rows 41. The path of the transported gases is identified by arrows 43. They enter via the connection flange 6 into the transport chamber, fitted with blades 41, 42 and get to discharge opening 46 through openings 44 in the inner sleeve 16 alongside shaft 11 and through openings 45 in the edge 21.

If, for example, the rotor blades 41 are equipped with slots 61, as represented in FIG. 2, then the rotor and the stator can be screwed together. In the embodiment of FIG. 3, that the rotor 12 is screwed with its suction side into the pressure side of the stator or the stator sleeve 17. After that, of the remaining sleeves 14, 15 are installed and the stator-/rotor systems 3 is braced in the housing 2.

Disassembly take place in reverse order.

With reference to FIG. 4, a friction vacuum pump has three coaxially nested stages. Into transport chamber 40, 40', 40" protrude rotor blades 41, 41', and 41", effecting the transportation of the gas, and also the stator blades 42', 42', 42", which are designed in accordance with the invention, (for example in accordance with FIG. 2). On the outside of the shaft 11, which has an enlarged diameter in the area of the sleeve 16 and on the interior side of the sleeve 16, the length of the blades are of a magnitude corresponding to the thread height of a molecular pump according to Holweck.

Involved here is the already initially mentioned, totally new pump surface configuration (Englander Geometry) which includes two opposite, intermeshing threads and which has the described benefits.

The path of the transported gases is identified by arrows. They enter through the connection flange 6 into the outer pump stage. After leaving the outer pump stage, they enter into the second pump stage between the rotor wall 18 and the sleeve 16, through which they flow in a direction which is opposite to the transport direction of the first pump stage. After another reversal in direction, they get through openings 53 in the edge 34 into the third pump stage and from there is in the manner already described in FIG. 1, to the discharge opening 46.

In the exemplary embodiments according to FIGS. 3 and 4, it is possible to also involve the shaft section at the level of the drive motor for transportation of the gases, if motor stator or motor rotor are equipped with pump-active surface configurations—appropriately with the Englander-Geometry. The exemplary embodiment according to FIG. 4 can easily be converted into a single stage friction vacuum pump. Without sleeve 17, the rotor bell 18 and the cover nut 27, only the third pumping stage is present and operative. The edges 26 and 28, as well as threads 42' can be eliminated. Another pre-requisite would be that the diameters of the vibration=/damping and sealing elements 4, 32 as well as of the frontal side of the sleeve 16 correspond to each other, so that it is possible to elastically support the rotor-stator-system 3 in the housing 2.

In the exemplary embodiment according to FIG. 3, the stator unit 9 and the rotor unit 8 are rigidly coupled with each other with respect to vibration. In the exemplary embodiment according to FIG. 4, between the upper bearing 36 and the inner side of edge 34, there is an O-ring 63 with significantly smaller diameter compared with the diameter of O-rings 24, 32. The O-ring 63 merely serves for bridging-over the tolerance fit. The O-ring 63 does not have any significant influence upon the selection of the gap between rotor- and stator unit.

Figure 5:
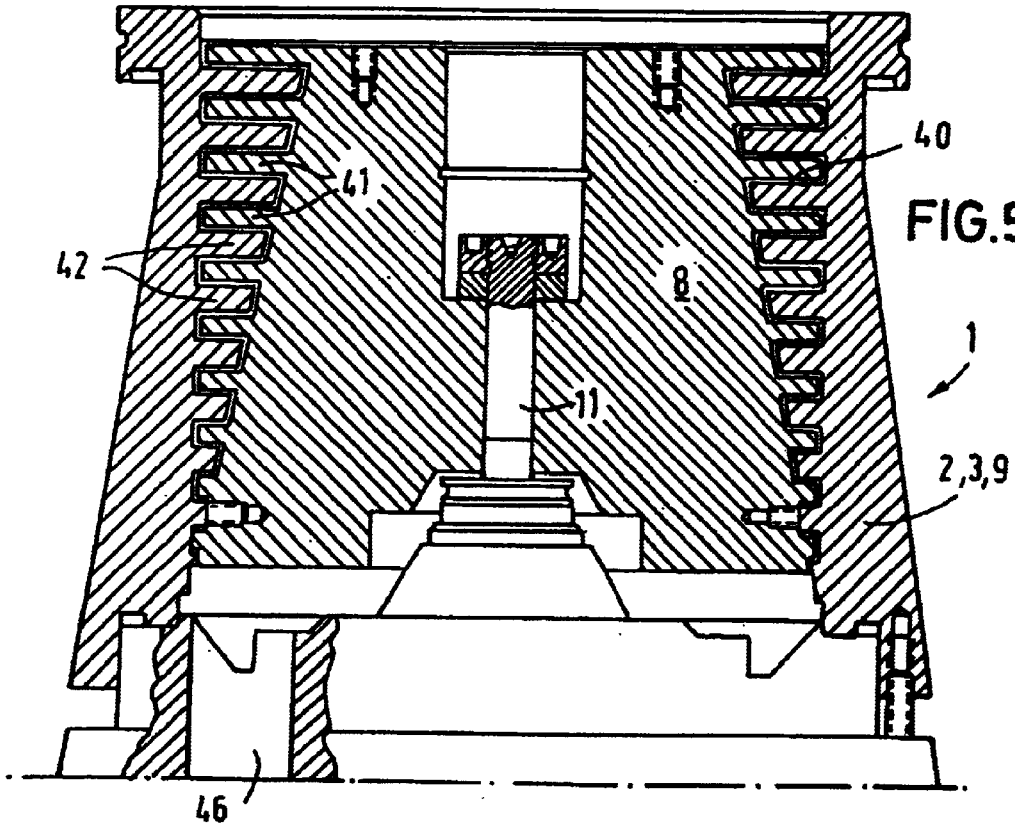
FIG. 5 depicts a section through a fiction vacuum pump with cross-sectionally tapering transport compartment and variously high projections protruding into the transport compartment.

In the exemplary embodiment according to FIGS. 5 and 6, a transport chamber 40 has a ring-shaped cross section which continuously decreases in the direction of gas transport, so that the lengths of the blades likewise decrease from the suction side toward the pressure side. The pump surface configuration continuously passes from turbo-molecular principle to the Englander configuration. Additionally, said exemplary embodiment differs from the other exemplary embodiments in that the stator blades 42 (and not the rotor blades 41) are fitted with slots 61 (FIG. 6). Furthermore, the thickness of the stator blades 42 is greater than the thickness of the rotor blades 41. FIG. 6 shows (in accordance with FIG. 2) a sections through the lay-out of these gas-transportation provoking projections, protruding into the transport compartment 40.

FIG. 5 emphasizes that the stator 3 and the housing 2 can be designed as a single piece in a turbo-molecular pump. Aside from the benefits of reduced construction volume and significantly reduced number of building components, there is likewise attained trouble-free heat transfer from inside to the outside and thus improved cooling of pump 1.

The realization of the invention is of particular benefit with small turbo-molecular pumps. With decreasing construction size, the detrimental portion of backstreaming increases in proportion to the transported gas flow and thereby disproportionately worsens the vacuum related properties of a pump. By virtue of the invention-specific reduction of the gaps between rotor and stator with the present new concept, it is possible to clearly improve the vacuum related data. Conversely, this means that a pump of this construction size can still be produced at economically reasonable expense. A contributory factor is the fact that the pump can be manufactured from relatively few parts.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A molecular vacuum pump including a stator having a stator blade package which includes at least one stator blade row, and a rotor having a rotor blade package which includes at least one rotor blade row, the rotor blade package intermeshing with the stator blade package in a functionally assembled state, wherein:

one of the rotor blade package and the stator blade package includes blades having slots whose arrangement, depth, and width are selected such that the stator and the rotor can be screwed together.

2. The vacuum pump as set forth in claim 1, wherein:

the pitch angles are identical for all blades of the blade package whose blades pass through the slots during the screwing together.

3. The vacuum pump as set forth in claim 1, wherein:

the rotor is a single unitary piece; and the stator is a single unitary piece.

4. The vacuum pump as set forth in claim 3, wherein:

the stator is also a pump housing.

5. The vacuum pump as set forth in claim 1, wherein:

the rotor is essentially bell-shaped.

6. The vacuum pump as set forth in claim 5, wherein:

an outer stator sleeve component and an inner stator sleeve component;

the rotor blade package includes a first rotor blade group disposed on an outside surface of the essentially bell-shaped rotor, and extending outwardly into a first transport compartment and a second rotor blade group disposed on an inside surface of the essentially bell-shaped rotor, and extending inwardly into a second transport compartment; and the stator blade package includes a first stator blade group disposed on an inside surface of the outer stator sleeve component, and extending inwardly into the first transport compartment and a second stator blade group disposed on an outside surface of the inner stator sleeve component, and extending outwardly into the second transport compartment.

7. The vacuum pump as set forth in claim 6, further comprising:

a shaft on which the rotor is rigidly mounted, an outer surface of the shaft together with an inner surface of the inner stator sleeve component together defining a third transport compartment through which gas is transported after passing through the first and the second transport compartments.

8. The vacuum pump as set forth in claim 7, further comprising:

a drive motor disposed below the inner stator sleeve component, said drive motor having surfaces which define an extension of the third transport compartment, said drive motor surfaces having a pump-active surface configuration.

9. The vacuum pump as set forth in claim 8, wherein:

the pump-active surface configuration includes an Englander geometry.

10. The vacuum pump as set forth in claim 1, wherein:

the rotor blade package includes a first rotor blade group having at least one rotor blade row, said first rotor blade group being disposed on a pressure-side region of the pump and having blade lengths which approximately correspond to the thread depth of a Holweck pump;

the stator blade package includes a first stator blade group having at least one stator blade row, said first stator blade group being disposed on the pressure-side region of the pump and having blade lengths which approximately correspond to the thread depth of a Holweck pump; and the first stator blade group and the first rotor blade group together from a pumping region with an Englander geometry.

11. The vacuum pump as set forth in claim 10, wherein:

the rotor blade package includes a second rotor blade group;

the stator blade package includes a second stator blade group;

the second rotor blade group and the second rotor blade group together form a pumping region which operates on the turbo principle; and a transition between the pumping region with an Englander geometry and the pumping region which operates on the turbo principle is an essentially continuous transition.

12. The vacuum pump as set forth in claim 1, wherein:

the one of the rotor blade package and the stator blade package which has slots is thicker than the blades of other blade packages of the pump.

13. The vacuum pump as set forth in claim 1, further comprising:

a coupling by which the stator and the rotor are coupled together with respect to vibration to form a rotor/stator system;

a housing inside within the rotor/stator system is disposed; and at least one vibration element by which the rotor/stator system is fastened within the housing.

14. The vacuum pump as set forth in claim 13, wherein:

the coupling includes at least one mechanical bearing.

15. The vacuum pump as set forth in claim 14, wherein the coupling further comprises:

an axial slide fit arranged between the mechanical bearing and one of the rotor and the stator.

16. The vacuum pump as set forth in claim 14, wherein the coupling further comprises:

an O-ring arranged between the mechanical bearing and the stator, whereby play in the fit therebetween is accommodated.

17. The vacuum pump as set forth in claim 13, wherein:

the coupling rigidly couples the rotor and the stator together with respect to vibration.

18. The vacuum pump as set forth in claim 13, wherein:

the housing with an end cap braces the rotor/stator system inside the housing.

19. The vacuum pump as set forth in claim 13, further comprising:

a central shaft on which the rotor is affixed; and at least one shaft bearing which supports the shaft in the stator.

20. The vacuum pump as set forth in claim 19, wherein:

the rotor has an essentially bell-shape; and three vacuum pumping stages are defined.

21. The vacuum pump as set forth in claim 20, wherein:

the stator includes a first stator sleeve, a second stator sleeve, and a third stator sleeve;

the first stator sleeve is arranged on a pressure side of the pump;

the second stator sleeve is arranged on a suction side of the pump and inside the bell-shaped rotor; and the third stator sleeve is arranged on the suction side of the pump and outside the bell-shaped rotor.

22. The vacuum pump as set forth in claim 21, further including:

a cover nut which threads onto the pressure side of the third sleeve and which clamps together an outer edge of the second sleeve and an outwardly oriented edge of the first sleeve.

23. The vacuum pump as set forth in claim 13, wherein:

the stator includes at least one stator sleeve and defines receiving regions within accept the at least one vibration element whereby the rotor/stator system is supported in the housing.

24. The vacuum pump as set forth in claim 23, wherein:

the stator forms a second interior housing.

25. The vacuum pump as set forth in claim 1, wherein:

the second interior housing is vacuum-tight; and the housing includes air slots.

26. A method for assembling a molecular vacuum pump, said pump including a stator having a stator blade package including at least one row of stator blades, and a rotor having a rotor blade package including at least one row of rotor blades, one of the rotor and stator blades having slots dimensioned to receive the other blades, the rotor blades package intermeshing with the stator blade package in the functionally assembled state, the method comprising:

screwing the rotor and the stator together into the assembly with the other blades passing through the slots to assemble the rotor blades and the stator blades in the functionally assembled state.

27. A vacuum pump comprising:

a ring of rotor blades having a rotor blade spacing, pitch, and thickness;

a ring of stator blades having a stator blade spacing, pitch, and thickness, the stator blade pitch being opposite to the rotor blade pitch, in an assembled relationship the ring to stator blade being rotatably disposed parallel to and closely adjacent the ring of stator blades;

one of the stator and rotor blades having slots having the spacing, pitch, and thickness of the other of the stator and rotor blades.

* * * * *